US009004566B2

(12) United States Patent
Pecoraro

(10) Patent No.: US 9,004,566 B2
(45) Date of Patent: Apr. 14, 2015

(54) COOPERATING LINKABLE, DEFORMABLE CHOPSTICKS

(71) Applicant: Keith M. Pecoraro, Indooroopilly (AU)

(72) Inventor: Keith M. Pecoraro, Indooroopilly (AU)

( * ) Notice: Subject to any disclaimer, the term of this patent is extended or adjusted under 35 U.S.C. 154(b) by 0 days.

(21) Appl. No.: 14/212,155

(22) Filed: Mar. 14, 2014

(65) Prior Publication Data

US 2014/0265402 A1 Sep. 18, 2014

Related U.S. Application Data

(60) Provisional application No. 61/798,059, filed on Mar. 15, 2013.

(51) Int. Cl.
*B66F 19/00* (2006.01)
*A47G 21/06* (2006.01)

(52) U.S. Cl.
CPC ..... *A47G 21/103* (2013.01)

(58) Field of Classification Search
CPC ..... B25B 9/02; B65G 7/12; A61B 17/30; A47G 21/10; A47G 21/103
USPC ..... 294/99.2, 218, 16
See application file for complete search history.

(56) References Cited

U.S. PATENT DOCUMENTS 2,711,339 A 4/1954 McGogy
3,637,248 A 1/1972 Arita
3,640,561 A 2/1972 Law
4,312,530 A * 1/1982 Young ..... 294/118
5,697,659 A * 12/1997 Calagui ..... 294/99.2
6,581,997 B1 6/2003 Martikainen et al.

(Continued)

FOREIGN PATENT DOCUMENTS

CN 2141670 Y 9/1993
CN 2197912 Y 5/1995

(Continued)

OTHER PUBLICATIONS

International Search Report, International Searching Authority, pp. 1-10, Aug. 1, 2014.

(Continued)

*Primary Examiner* — Stephen Vu
(74) *Attorney, Agent, or Firm* — Samuel M. Freund; Cochran Freund & Young LLC

(57) ABSTRACT

A pair of chopsticks that may be reversibly attached in a cooperating manner for providing a forceps- or tweezers-like spring action for grasping objects, such as food, or for being used in the conventional manner for using chopsticks, is described. Identical angled channels located in the vicinity of the non-grasping end of each chopstick and having a depth of about one-half the width of the chopstick, permit the opposing channels to be fitted together to join the chopsticks. A retaining member may be wrapped around the channel joint to stabilize the joint and hold the chopsticks together. In another embodiment, two shallow angled side indentations are cut into the width of each chopstick at diagonally opposing sides of the primary angled channel formed therein, creating compression surfaces which oppose rotation and opening of the channel joint. Back cuts in the side indentation and in the primary channel permit the chopsticks to be reversibly snap-locked together such that the chopsticks may be assembled and disassembled as desired. In this situation, no external retaining tension member is required to maintain a stable joint during use.

19 Claims, 11 Drawing Sheets

(56) References Cited

U.S. PATENT DOCUMENTS

| | | | | |
|---|---|---|---|---|
| 8,042,851 | B2 | 10/2011 | Lai Martinez | |
| D683,597 | S | 6/2013 | Dixon | |
| 8,562,054 | B2 * | 10/2013 | Keller | 294/218 |
| 2003/0042746 | A1 | 3/2003 | Prodanic | |
| 2009/0165307 | A1 * | 7/2009 | Lam et al. | 30/123 |
| 2010/0013254 | A1 | 1/2010 | Lai Martinez | |
| 2011/0169284 | A1 * | 7/2011 | Rosen | 294/1.1 |
| 2011/0298236 | A1 | 12/2011 | Keller | |

FOREIGN PATENT DOCUMENTS

| | | | |
|---|---|---|---|
| CN | 2534914 | Y | 2/2003 |
| CN | 2715641 | Y | 8/2005 |
| CN | 201194712 | Y | 2/2009 |
| CN | 201905658 | U | 7/2011 |
| CN | 202020218 | U | 11/2011 |
| CN | 202874846 | U | 4/2013 |
| CN | 203137935 | U | 8/2013 |
| JP | 8280516 | | 10/1996 |
| JP | 2004216088 | A | 8/2004 |
| KR | 2012133183 | | 12/2012 |
| WO | WO 9741762 | | 11/1997 |

OTHER PUBLICATIONS www.skewers.co.us. Spikomat Ltd (T/A Skewers)—Southside House Great North Rd Sutton-on-Trent Newark NG23 6 QS. 2014. One page.

* cited by examiner

COOPERATING LINKABLE, DEFORMABLE CHOPSTICKS

RELATED CASES

The present patent application claims the benefit of Provisional Patent Application Ser. No. 61/798,059 filed on Mar. 15, 2013, entitled "Cooperating Notched, Deformable Chopsticks" by Keith M. Pecoraro, said application being hereby incorporated by reference herein for all that it discloses and teaches.

FIELD OF THE INVENTION

The present invention relates generally to eating utensils and, more particularly, to flexible chopsticks which may be cooperatively attached to enable more facile use for grasping objects.

BACKGROUND

Chopsticks can be difficult for many people to use due to the manual dexterity and coordination required in manipulating the individual chopsticks so that they work as a unified pair. Many products have been designed to connect the individual chopsticks to provide spring-like action, thereby permitting unskilled users to hold and manipulate the chopsticks more easily.

Solutions include spring-like, flexible bridging members for connecting two chopsticks to form a unified pair. Since an additional, generally plastic, member is required to accomplish this function, the cost of the utensil is increased and, if not reused, the member wastes resources and increases environmental pollution. Further, in a restaurant environment, waiters must inquire as to who needs assistance in using standard chopsticks, making some patrons uncomfortable and requiring extra time.

Integral, tweezer-like tools have been designed for picking up food. However, such complex shapes are generally expensive to manufacture and package. Chopsticks have also been joined near one end using channeled joint portions, with elongated thin slits providing a leaf-spring-like mechanism, wherein a pincer-like function is obtained, the spring elements opening the chopsticks when the user is not squeezing them together. This action also tends to make the chopsticks separate if not carefully held together by a user.

A variation of this latter apparatus includes pair of molded plastic chopsticks joined by an oblique channel close to the upper end of the chopsticks having ribs emerging towards the inside of the channel, whereby the chopsticks are adapted to be snap-fitted together. The lower ends thereof may be brought together because of the flexible nature of the material of fabrication. However, when not being gripped by the user, the geometry of the simple oblique channel allows the chopsticks to rotate so that the angle between them increases and the channel joint no longer holds together. Additionally, this configuration tends to place large shear forces on the channel, making it impractical to manufacture the chopsticks from many common materials.

SUMMARY OF THE INVENTION

Embodiments of the present invention overcome the disadvantages and limitations of the prior art by providing chopsticks which may be used in the traditional manner when unattached, or used with the chopsticks cooperatively attached to one another for grasping objects.

Another object of embodiments of the present invention is to provide chopsticks which may be cooperatively attached to one another for grasping objects without requiring an added spring-like mechanism for automatically separating the grasping ends of the chopsticks when the user wishes to release the object.

Yet another object of embodiments of the present invention is to provide chopsticks which may be cooperatively attached to one another for grasping objects, and which require only a minor effort to squeeze the grasping ends together for grasping an object.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the pair of chopsticks hereof, includes: a first chopstick having a chosen long dimension an upper side and an opposing lower side, an outer side and an opposing inner side, a food grasping end and a second end, a first channel in the upper side disposed at a chosen angle relative to the long dimension of the first chopstick in the region of the second end thereof, having a selected depth, and a chosen width, and forming a first base member between the depth of the first channel and the lower side; a second chopstick, identical to the first chopstick, having a chosen long dimension an upper side and an opposing lower side, an outer side and an inner side, a food grasping end and a second end, a second channel in the upper side disposed at a chosen angle relative to the long dimension of said first chopstick in the region of the second end thereof having a selected depth, and a chosen width, and forming a second base member between the depth of the second channel and the lower side; wherein the first base member of the first chopstick is inserted into the second channel of the second chopstick, with the second base member of the second chopstick being inserted into the first channel of the first chopstick, forming a joint having the chosen angle between the first chopstick and the second chopstick; and a retaining member for holding the first chopstick and the second chopstick together at the joint.

In another aspect of the invention and in accordance with its objects and purposes, the pair of chopsticks hereof, includes: a first chopstick having a chosen long dimension an upper side and an opposing lower side, an outer side and an inner side, a food grasping end and a second end, a first channel in the upper side disposed at a chosen oblique angle relative to the long dimension of the first chopstick in the region of the second end thereof, the first channel opening both into the outer side and the inner side and having a first end closest to the second end of the first chopstick, and a second end closest to the grasping end and a midpoint therebetween, having a selected depth, and a chosen width, forming a first base member between the depth of the first channel and the lower side, there being a first slanted indentation in the outer side beginning at the first end of the channel and ending at the midpoint thereof, and a second slanted indentation in the inner side beginning at the second end of the channel and ending at the midpoint thereof, forming a first side stop having a first face, and a second side stop having a second face, respectively, at the midpoint; and a second chopstick, identical to the first chopstick, having a chosen long dimension an upper side and an opposing lower side, an outer side and an inner side, a food grasping end and a second end, a second channel in the upper side disposed at a chosen oblique angle relative to the long dimension of the second chopstick in the region of the second end thereof, the second channel opening both into the outer side and the inner side and having a first end closest to the second end of said second chopstick, and a second end closest to the grasping end and a midpoint therebetween, having a selected depth, and a chosen width, forming a second base member between the depth of the second channel and the lower side, there being a first slanted indentation in the outer side beginning at the first end of the channel and ending at the midpoint thereof, and a second slanted indentation in the inner side beginning at the second end of the channel and ending at the midpoint thereof, forming a first side stop having a first face, and a second side stop having a second face, respectively, at the midpoint; wherein the first base member of the first chopstick is inserted into the second channel of the second chopstick, with the second base member of the second chopstick being inserted into the first channel of the first chopstick, forming a joint having the chosen oblique angle, wherein the first face of the first side stop of the first chopstick engages the second face of the second side stop of the second chopstick and the second face of the second side stop of the first chopstick engages the first face of the first side stop of the second chopstick, thereby preventing rotation of the first chopstick and the second chopstick in the joint.

Benefits and advantages of embodiments of the present invention include, but are not limited to, providing flexible chopsticks which may be reversibly cooperatively joined to enable more facile use thereof for grasping objects. The identical chopsticks may be fabricated from sustainable materials with a minimum of waste, and can be manufactured as a pair in a single, attached unit, such that the individual chopsticks can then be separated prior to use.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIG. 6A is a schematic representation of a front view of the embodiment of the invention shown in FIGS. 1-3 hereof illustrating a pair of packaged chopsticks manufactured as an integral unit, and ready for use once removed from the packaging and separated from each other, the packaging having the retainer strip shown in FIGS. 1 and 2 hereof, integrally formed therewith; while

DETAILED DESCRIPTION OF THE INVENTION

Embodiments of the present invention include a pair of chopsticks that are easily attached and detached in a cooperating manner for providing a forceps- or tweezers-like spring action for grasping objects, such as food, or for being used in the conventional manner for using chopsticks. Identical angled channels located in the vicinity of the non-grasping end of each chopstick and having a depth of about one-half the width of the chopstick, permit the opposing channels to be fitted together to join the chopsticks. A retaining member may be wrapped around the channel joint to stabilize the joint and hold the chopsticks together. A portion of the material is removed between the joining channel and the grasping end of each chopstick, thereby reducing the rigidity of the chopstick and its resistance to bending. That is, a spring-like section is generated, whereby although the chopsticks remain straight, they may be flexed by application of only moderate squeezing force between the spring portion and the grasping end of the chopstick, with mild shear forces generated at the channels. As will be described hereinbelow, this may be accomplished in several ways. The assembled chopstick pair may then be operated in a similar manner to tweezers or forceps, or salad tongs sprung at one end, for grasping food.

The chopsticks may be fabricated as a pair from a single piece of bamboo or other wood with a thin line of material therebetween such that the individual chopsticks can be separated before use. The retaining member may be formed from a portion of the paper chopstick packaging material. The chopsticks may be fabricated from other materials as well, including plastic and metal, as examples.

The chopsticks may be straight or tapered, and may have square, circular or oval cross-sections, as examples.

In another embodiment, two shallow angled side indentations are cut into the width of each chopstick at diagonally opposing sides of the primary angled channel formed therein, creating compression surfaces which oppose rotation and opening of the channel joint. Back cuts in the side indentation and in the primary channel permit the chopsticks to be reversibly snap-locked together such that the chopsticks may be assembled and disassembled as desired. In this situation, no external retaining tension member is required at the assembled channel joint.

Figure 1:
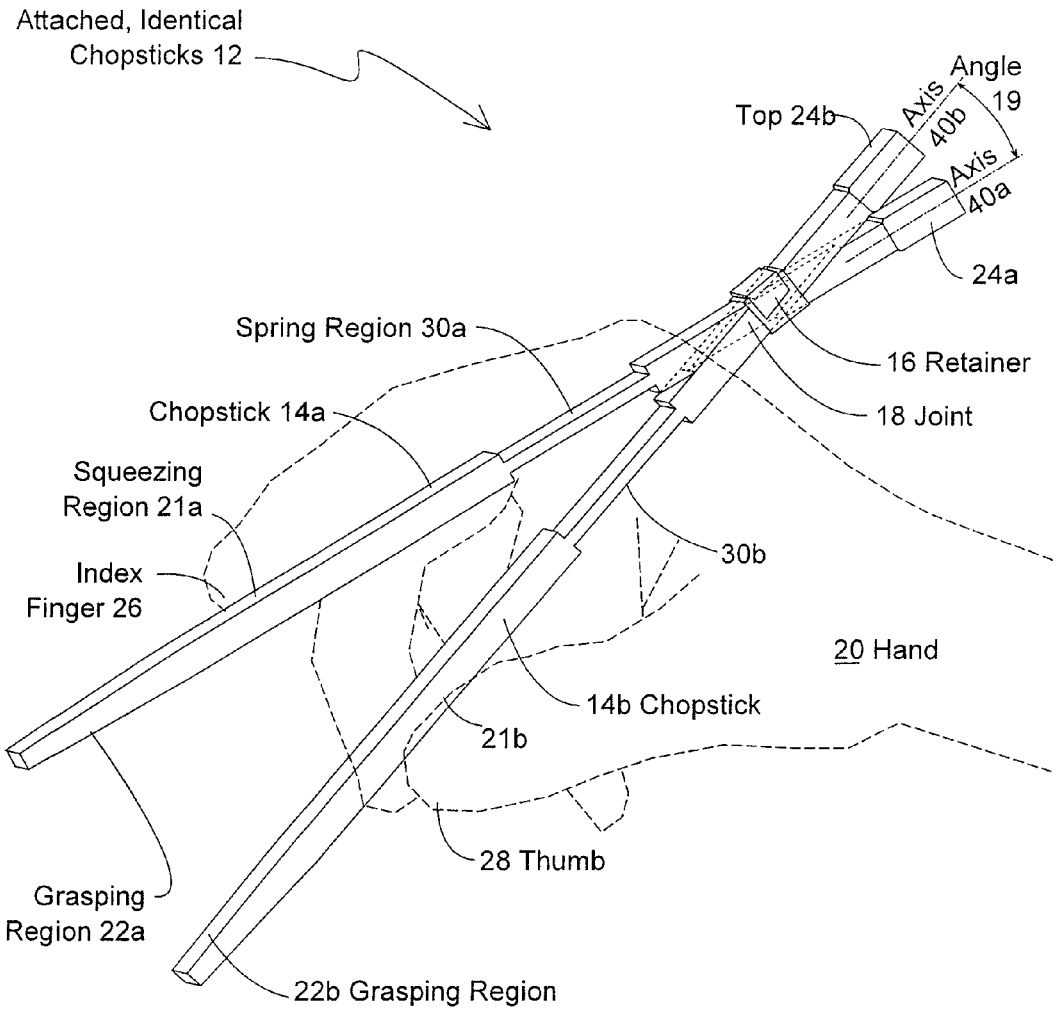
FIG. 1 is a schematic representation of a perspective view of an embodiment of the present invention showing a pair of cooperatively attached chopsticks in their normally open position, each chopstick having a spring portion formed in the body thereof to enable easy bending, and showing a retainer strip for holding the chopsticks in their attached condition.

Reference will now be made in detail to the present embodiments of the invention, examples of which are illustrated in the accompanying drawings. In the FIGURES, similar structure will be identified using identical reference characters. It will be understood that the FIGURES are for the purpose of describing particular embodiments of the invention and are not intended to limit the invention thereto. Turning now to FIG. 1, a pair of attached identical chopsticks, 12, is shown in its open configuration, and includes chopsticks, 14*a*, and, 14*b*, and retaining member, 16, shown as a band, strip or ribbon capable of being wrapped around joint, 18, which keeps the two chopsticks at chosen angle, 19. Retaining member 16 may also include cords or strings. Chopsticks 12 may be used as a utensil for grasping food and other objects. Hand, 20, is shown holding the chopsticks at the squeezing region, 21*a*, and, 21*b*, toward the grasping region, 22*a*, and 22*b*, thereof, opposite top region, 24*a*, and 24*b*.

Figure 2:
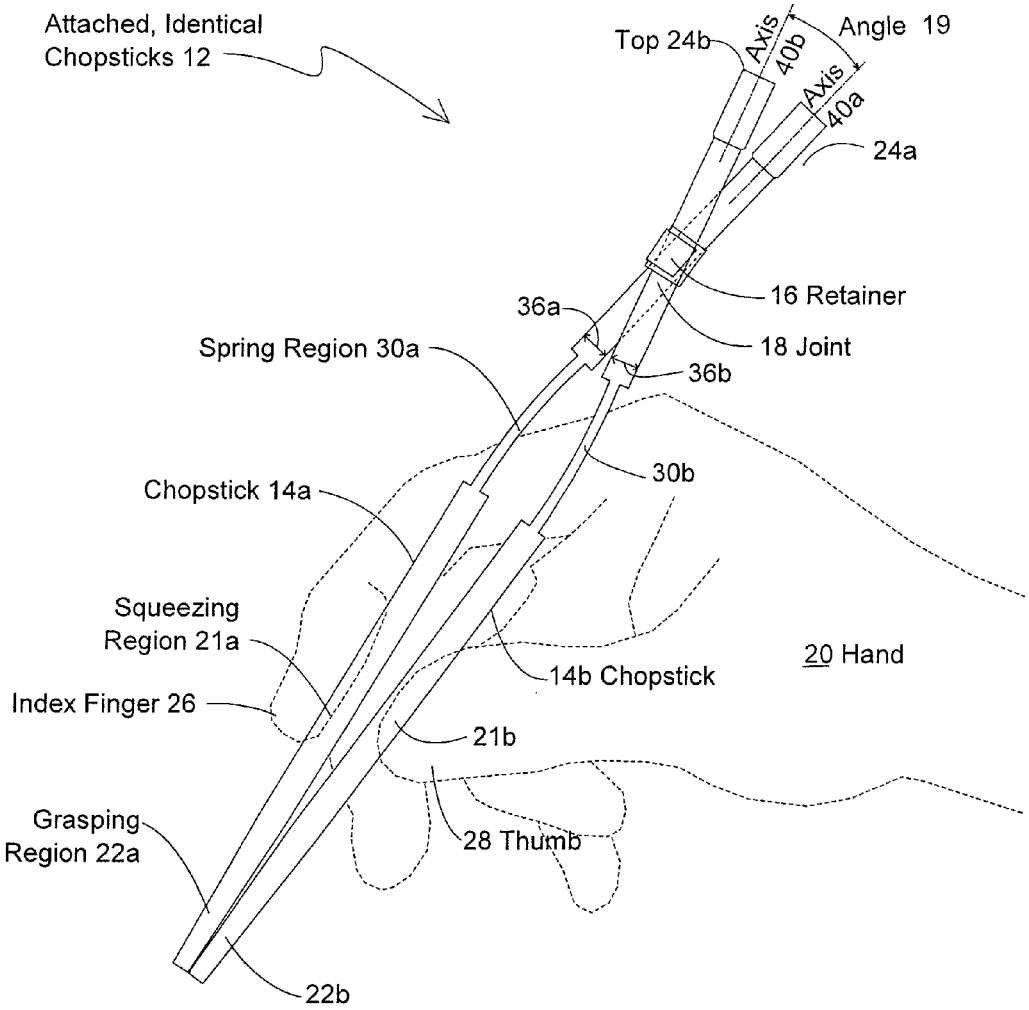
FIG. 2 is a schematic representation of a side view of the embodiment of the invention shown in FIG. 1 hereof, illustrating the flexibility imparted to the chopsticks by the spring portion of the cooperatively attached chopsticks, thereby permitting the chopsticks to be used for grasping objects, and illustrating a retainer strip for holding the chopsticks in their attached condition.

FIG. 2 shows hand 20 squeezing the squeezing region 21*a* and 21*b*, forcing the grasping regions 22*a* and 22*b* together, thereby enabling chopsticks 12 to grasp food or other objects. It may be observed from FIG. 1 hereof that in the open configuration, chopsticks 14*a* and 14*b* are generally straight, while FIG. 2 illustrates that in the grasping configuration, chopsticks 14*a* and 14*b* are bent inwardly by the action of forefinger, 26, and thumb, 28, of hand 20, thereby reducing the chosen angle 19 imparted to the attached pair of chopsticks by joint 18. To achieve this function, chopsticks 14*a* and 14*b* have spring regions, 30*a*, and, 30*b*, respectively, which are thinner than the chopstick thickness, 36*a*, and 36*b*, to increase flexibility in the direction of bending such that the chopsticks may be bent without applying significant force or breaking joint 18.

Figure 3:
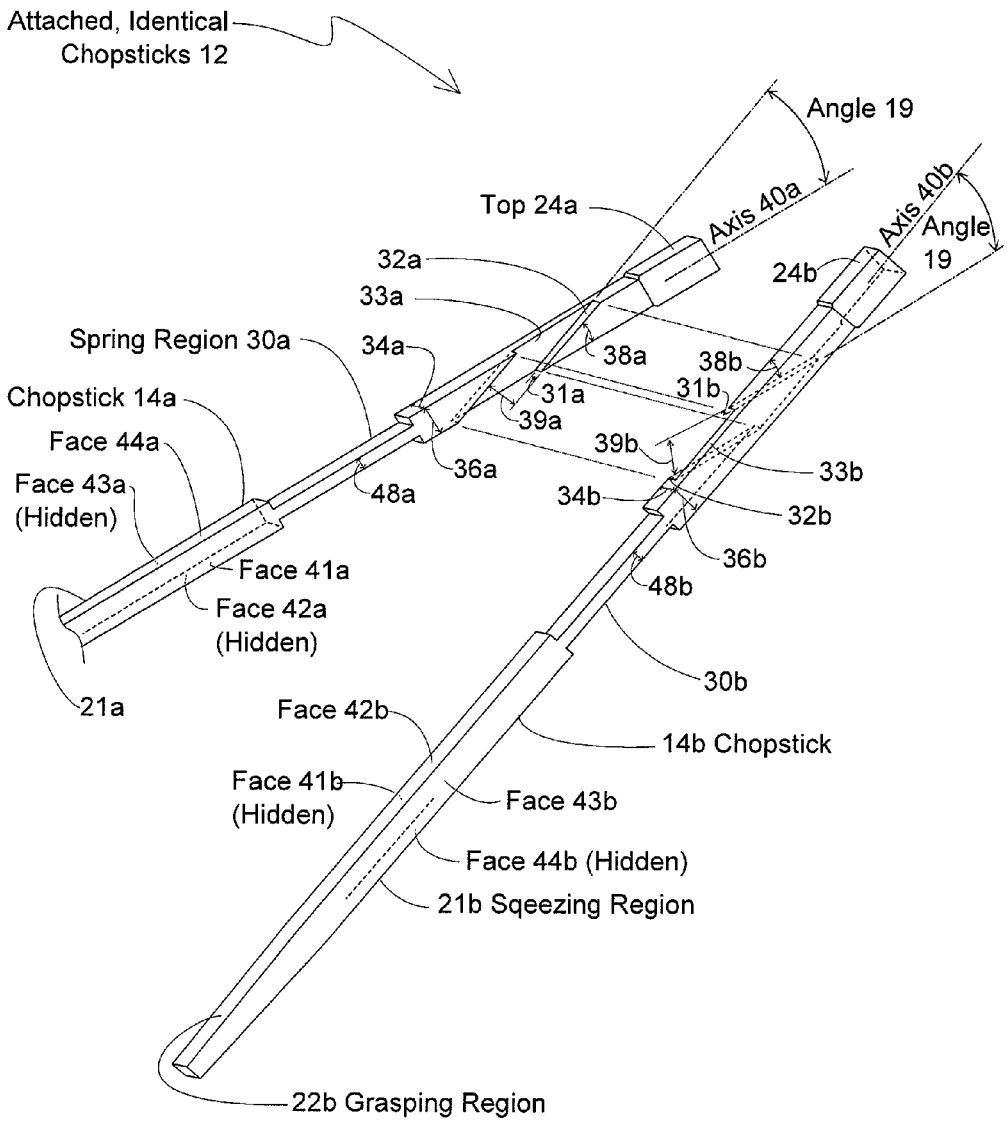
FIG. 3 is a schematic representation of an exploded perspective view of the embodiment of the invention shown in FIG. 1 hereof, illustrating identical oblique notches formed in one side of each of the separated identical chopsticks between the spring portion and the end of each chopstick, which enable the chopsticks to be operatively joined as shown in FIGS. 1 and 2 hereof.

FIG. 3 illustrates a pair of separated chopsticks, which as stated hereinabove can be used in the traditional manner for using chopsticks. Each identical chopstick 14*a*, 14*b*, may be constructed from a single piece of material. Channel, 32*a*, is formed at a chosen angle near top 24*a* of chopstick 14*a*, with an identical channel, 32*b*, formed in the identical location in chopstick 14*b*. The material remaining behind channels, 32*a*, and, 32*b* are termed base members, 33*a*, and, 33*b*, respectively. The depths, 31*a*, and, 31*b*, of channels 32*a* and 32*b* are typically about one-half of width, 34*a*, 34*b*, of the side of the chopstick in which the channel is formed, but may be less. Channel widths, 39*a*, and, 39*b*, may be equal to chopstick thickness 36*a*, and, 36*b*. Channels 32*a* and 32*b*, are formed at angles, 38*a*, and, 38*b*, between about 15° and about 30° from axes, 40*a*, and, 40*b*, parallel to the length (long dimension) of chopsticks 14*a*, and 14*b*, respectively, such that when chopsticks 14*a* and 14*b* are joined into assembly 12 by placing opposing channels 32*a*, and 32*b* together, joint 18 is formed having a resultant angle 19 (FIG. 1 hereof) between chopsticks 14*a* and 14*b* equal to angles 38*a* and 38*b*. Retainer 16 (FIGS. 1 and 2 hereof) may be affixed around the joined channels 32 to add rigidity to joint 18 and to keep chopsticks 14*a* and 14*b* together.

Lengthwise sides or faces of chopsticks 14*a* and 14*b* are labeled as faces, 41*a* (upper side or face), and, 41*b*, 42*a* (inner side or face), and, 42*b*, 43*a* (opposing lower side or face), and, 43*b*, and 44*a* (opposing outer side or face), and 44*b*. Primary channels 32*a* and 32*b* are cut into the depth of faces 41*a* and 41*b*, respectively. Springs 30*a* and 30*b* are created by cuts into the depth of faces 42*a* and 42*b* and/or 44*a* and 44*b*. Faces 43*a* and 43*b* may be left uncut depth wise.

Figure 4:
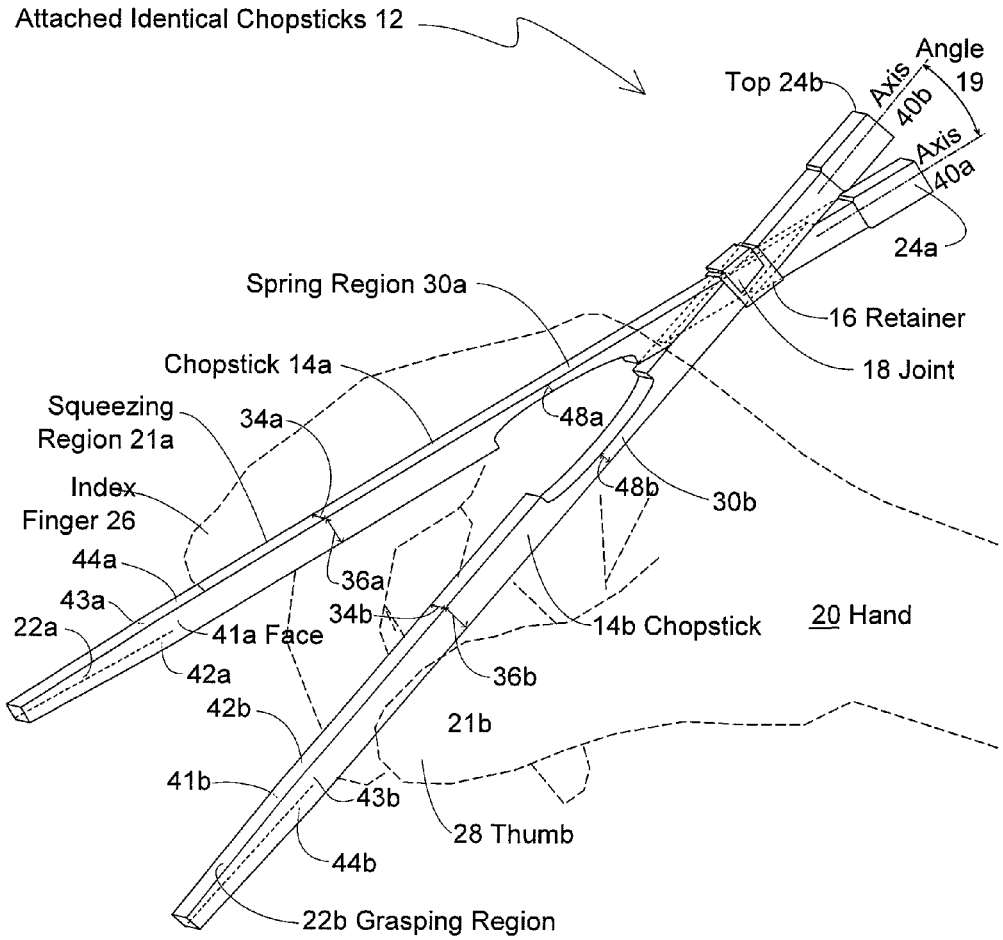
FIG. 4 is a schematic representation of a perspective view of the embodiment of the present invention shown in FIG. 1 hereof, illustrating another embodiment of the spring portion thereof.

FIG. 4 illustrates another embodiment of spring portions 30*a* and 30*b*, showing a continuous indentation in a portion of faces 42*a* and 42*b*, of chopsticks 14*a* and 14*b*, respectively, producing a region having narrower widths, 48*a*, and, 48*b*, than the width of the body, 36*a* and 36*b*, thereof at that location. Other effective spring shapes may include long, narrow sections having arc or other shapes on both sides of the chopstick, or thinning shapes or indentations only on one side of the chopsticks.

Figure 5:
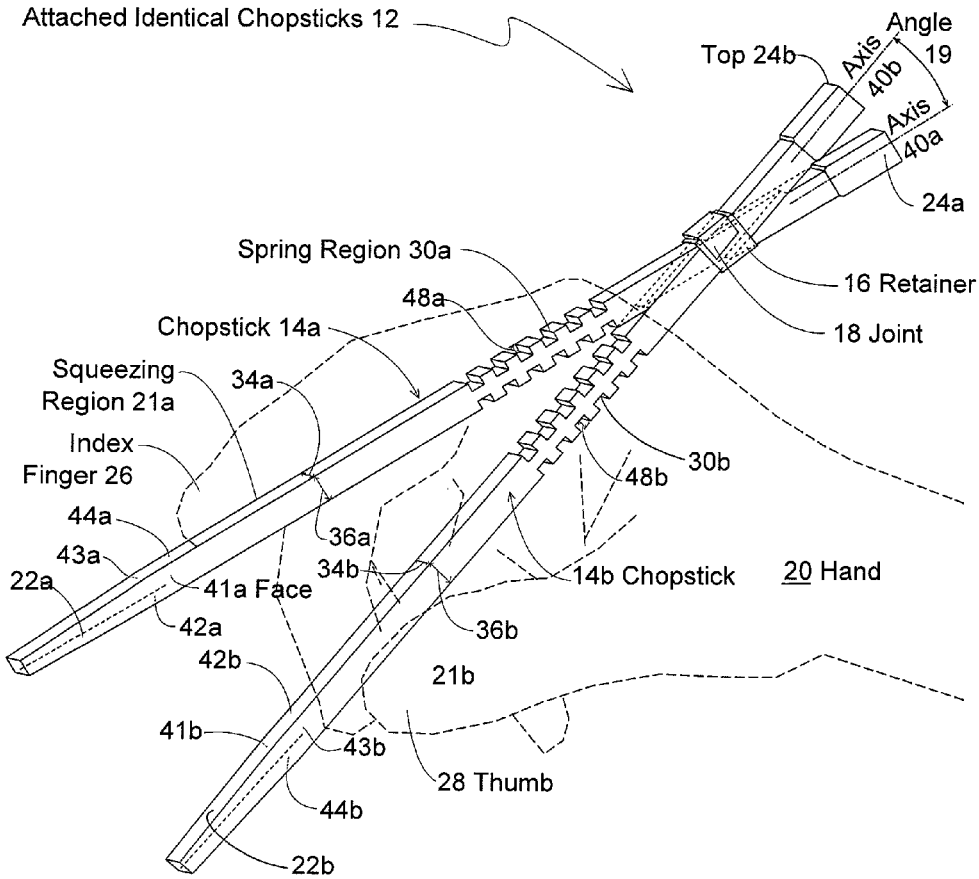
FIG. 5 is a schematic representation of a perspective view of another embodiment of the present invention shown in FIGS. 1-4 hereof, illustrating another embodiment of the spring portion thereof.

FIG. 5 illustrates another embodiment of spring portions 30*a* and 30*b*. Springs 30*a* and 30*b* may include a series of multiple, short springs which form a serrated or comb-like structure formed in one or both opposing faces 42*a* and 44*a*, and 42*b* and 44*b*, of chopsticks 14*a* and 14*b*, respectively, and generally perpendicular to faces 42*a* and 44*a*, and 42*b* and 44*b*, respectively, wherein at least one portion has a narrower width than the thickness, 36*a* and 36*b*, of sides 43*a* and 43*b*, respectively. As illustrated in FIG. 2 hereof, this reduces the stiffness of chopsticks 14*a* and 14*b* in the plane of bending and allows assembly 12 of chopsticks 14*a* and 14*b* to be flexed with the application of only a moderate squeezing force between finger 26 and thumb 28 of hand 20, and places minimal stress on joint 18, which brings grasping regions 22*a* and 22*b* together for grasping food and other objects.

Figure 6A:
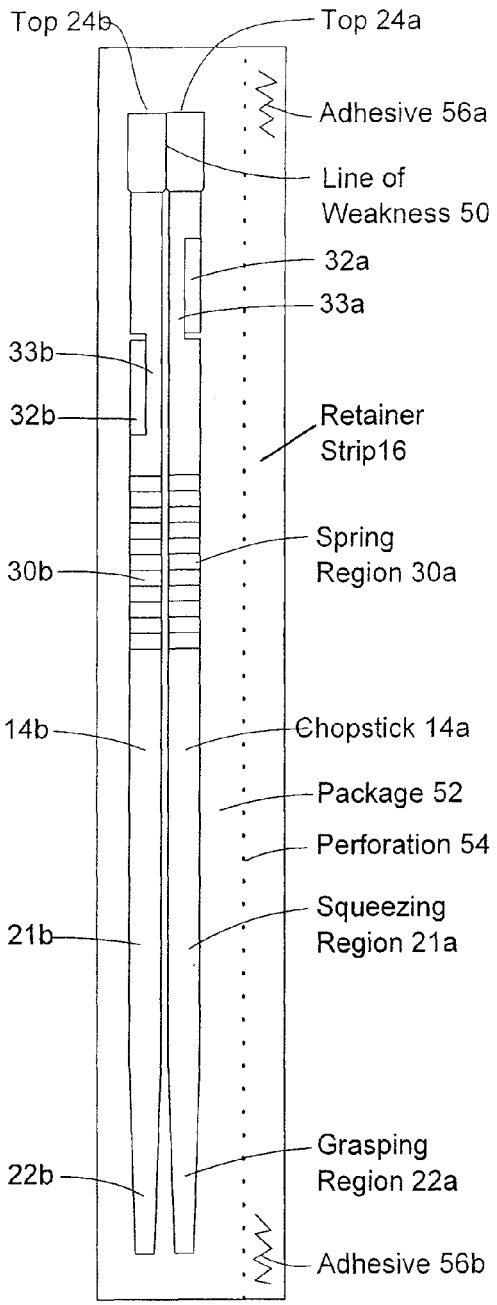

FIG. 6A shows that a pair of chopsticks 14*a* and 14*b* may be fabricated from a single piece of material such that they are readily separable along a line of weakness, 50, allowing convenient packaging and/or distribution as a unit. Retainer member 16 may be inside of or, as shown in FIG. 6A, integral with paper or plastic packaging, 52, for chopsticks pair 10. Perforation, 54, may be included for more easily detaching retaining member 16 from packaging 52. Once retainer member 16 is wrapped around joint 18, it may be secured using adhesive patches, 56*a*, and, 56*b*, located near the ends of retainer member 16. One end of retainer 16 may be slipped into joint 18 to secure it, the remainder of retainer 16 then being wrapped around the joint, the other end being affixed with adhesive 56*a* or 56*b*. Other methods for stabilizing joint 18 may include use of adhesives in the joint itself, elastic bands, clips, and string, as examples.

Figure 6B:
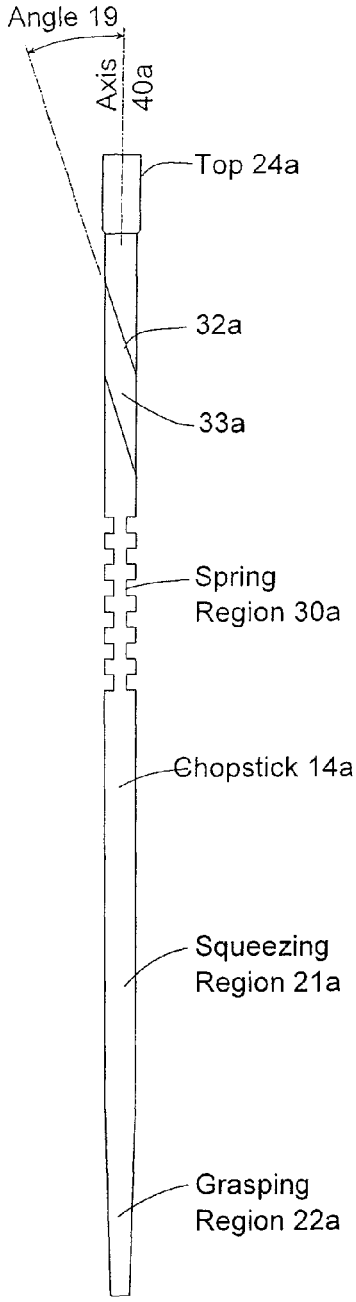
FIG. 6B is a schematic representation of a side view thereof.

FIG. 6B is a schematic representation of a side view of attached chopsticks 12 and 14, shown in FIG. 5A hereof.

Figure 7:
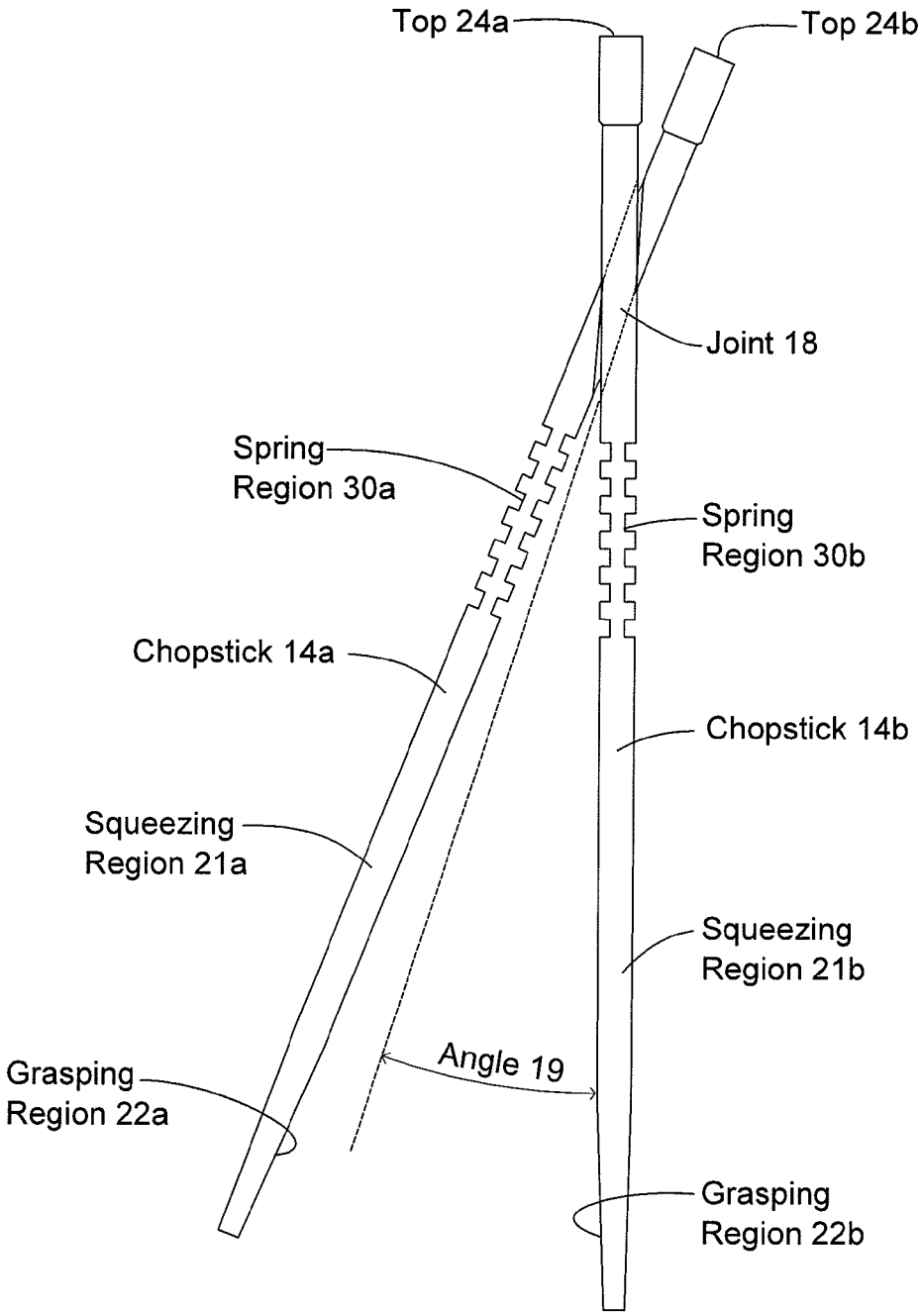
FIG. 7 is a schematic representation of a perspective view of a pair of chopsticks similar to the embodiments of FIGS. 1 and 6B hereof, and illustrates that any looseness in the joint or flexibility in the material may allow the chopsticks to rotate apart if not held in place by a retaining member.

FIG. 7 is a schematic representation of a side view of a pair of identical chopsticks 12 with joint 18 similar to the embodiments of FIGS. 1 through 6B hereof, and illustrates that any looseness in the joint or flexibility in the material may allow chopsticks 14*a* and 14*b* to rotate apart at joint 18 if not held in place by a retaining member such as member 16 or another method for stabilizing joint 18.

Figure 8A:
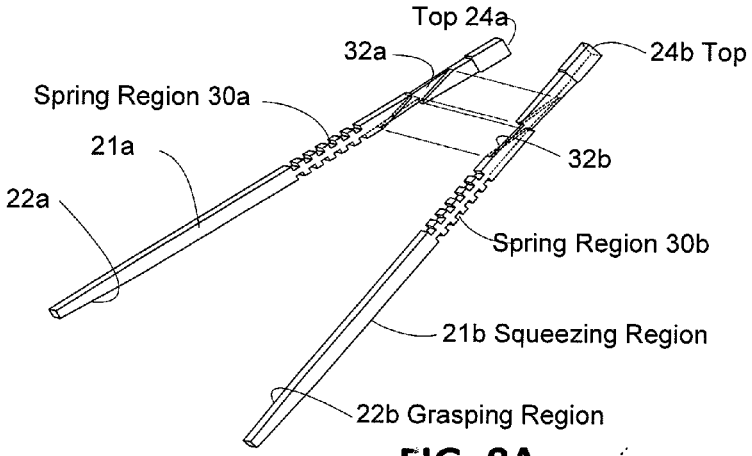
FIG. 8A is a schematic representation of an exploded perspective view of another embodiment of chopsticks in which the primary channels forming the joint are modified and augmented by side indentations, which form side stops, shown in FIG. 8B, to reduce the relative rotation of the chopsticks illustrated in FIG. 7 such that a retaining member is no longer required.
Figure 8B:
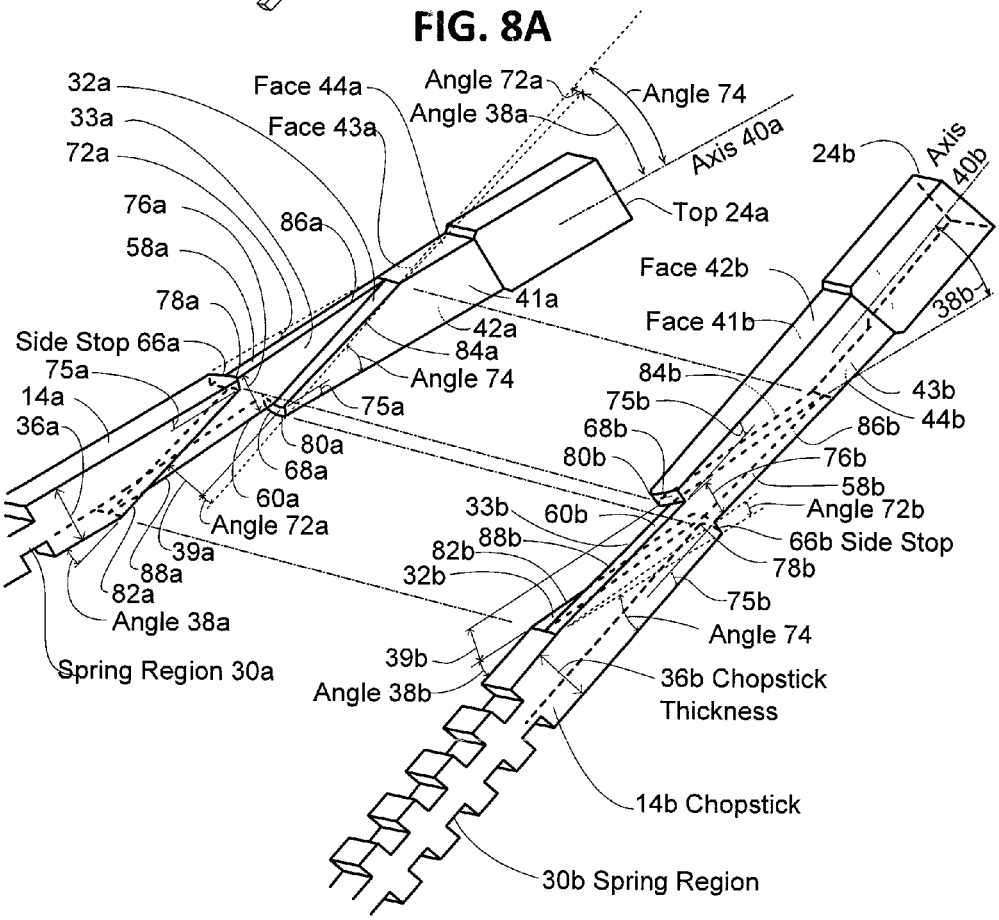
Figure 9:
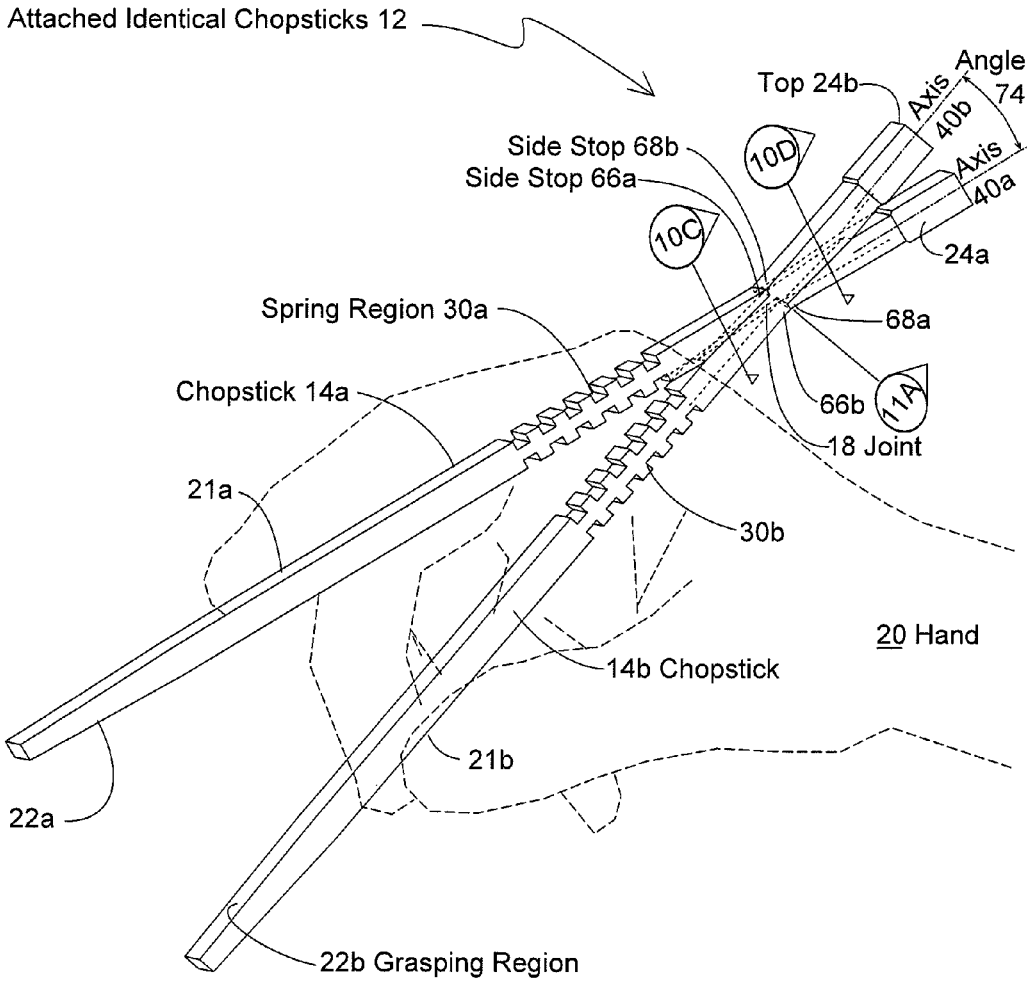
FIG. 9 is a schematic representation of a perspective view of the joint and surrounding elements for an attached pair of chopsticks employing the embodiment of the joint shown in FIGS. 8A and 8B hereof.

FIG. 8A is a schematic representation of an exploded perspective view of another embodiment of chopsticks 12, in which primary channels 32*a* and 32*b*, forming joint 18 are modified and augmented by side indentations, 58*a*, and, 60*a*, and, 58*b*, and, 60*b*, which form side stops, 66*a*, and, 68*a*, and, 66*b*, and, 68*b*, having widths, 75*a*, and, 75*b*, respectively, shown in FIG. 8B, for reducing the relative rotation of the chopsticks illustrated in FIG. 7, such that a retaining member, such as retaining member 16 (illustrated in FIG. 4 hereof), is no longer required to achieve operability of joint 18 during extended use. FIG. 8B is a schematic representation of an enlarged, exploded perspective view of channels 32*a* and 32*b* and surrounding elements for separated chopsticks 14*a* and 14*b* of this embodiment, while FIG. 9 is a schematic representation of a perspective view of joint 18 and the surrounding elements for the attached pair of chopsticks 12 thereof.

Figure 10A:
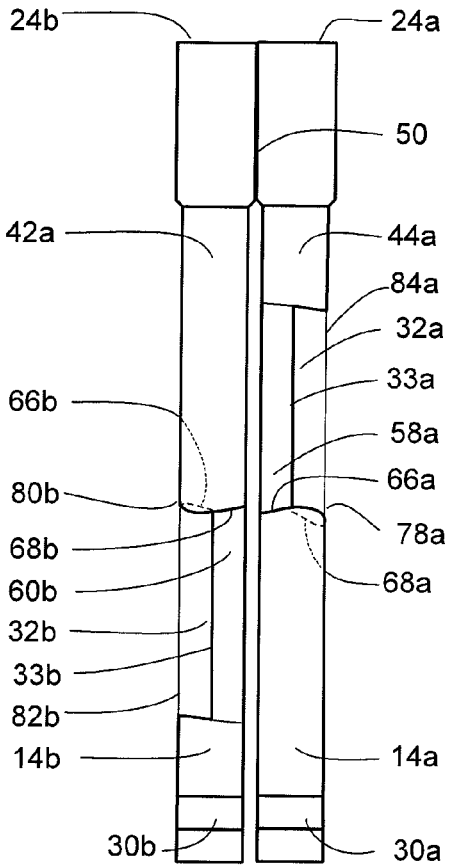
FIG. 10A is a schematic representation of a front view of the upper portion of the chopsticks as they might be fabricated from a single piece of material, wherein they are readily separable along a line of weakness.
Figure 10B:
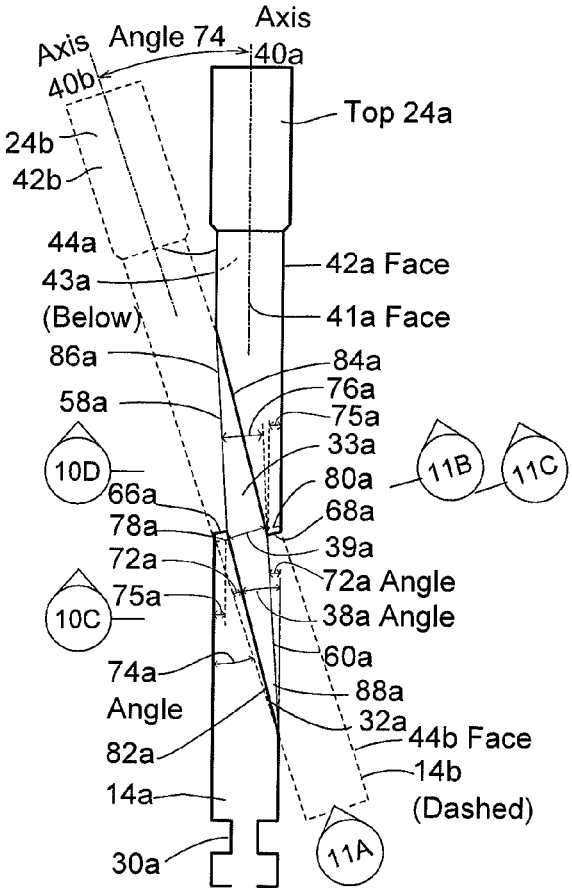
FIG. 10B is a schematic representation of a side view of the joint of assembled chopsticks.
Figure 10C:
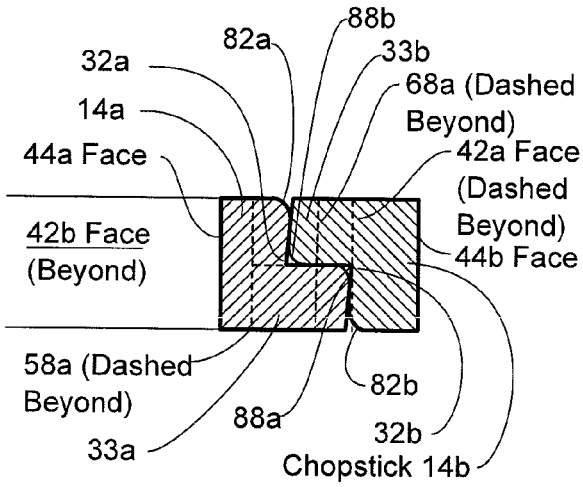
FIGS. 10C and 10D are schematic representations of transverse sections cut through the joint at the locations denoted in FIGS. 9 and 10B.
Figure 10D:
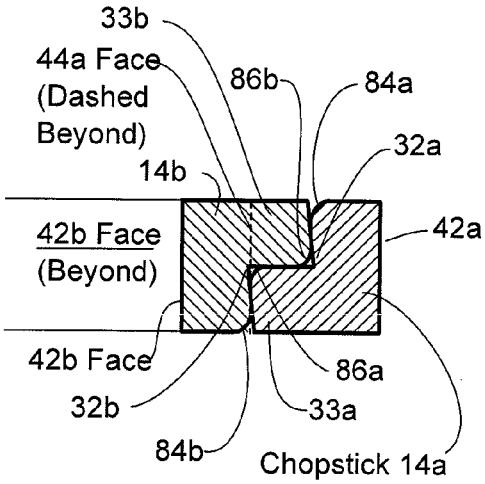

FIG. 10A is a schematic representation of a front view of the upper portion of chopsticks 14*a* and 14*b* as they might be fabricated from a single piece of material, wherein they are readily separable along a line of weakness, 50, while FIG. 10B is a schematic representation of a side view of joint 18 of assembled chopsticks 12, wherein chopstick 14*b* is dashed to permit clear labeling of the details of chopstick 14*a*. FIGS. 10C and 10D are schematic representations of transverse sections cut through joint 18 at the locations denoted in FIGS. 9 and 10B. Shallow-angled, slanted side indentations, 58*a*, and, 60*a*, are formed in faces 44*a* and 42*a*, respectively, of chopstick 14*a*, and shallow-angled, slanted side indentations 58*b* and 60*b* are formed in faces 44*b* and 42*b*, respectively, of chopstick 14*b* beginning at diagonally opposing ends of channels 32*a* and 32*b*, respectively, and ending at about the midpoint thereof, resulting in side-stops 66*a* and 68*a*, adjacent to faces 44*a* and 42*a*, respectively, at about the midpoint of channel 32*a* in chopstick 14*a*, and in side stops 66*b* and 68*b*, adjacent to faces 44*a* and 42*a*, respectively, at about the midpoint of channel 32*b* in chopstick 14*b*. When the chopsticks are assembled to form joint 18, side indentations 58*a* and 60*a* fit into primary channel 32*b* in chopstick 14*b*, side indentations 58*b* and 60*b* fit into primary channel 32*a* in chopstick 14*a*, and the face of side-stop 66*a* abuts the face of side-stop 68*b*, and the face of side-stop 66*b* abuts face of side-stop 68*a*, such that they will form an interlocking unit which holds the assembly together. The abutted faces of the side-stops compress together and prevent joint 18 from rotating apart as it otherwise could (as depicted in FIG. 7). The base members may also have have interlocking facing ribbed surfaces or other roughened surfaces located at the sides or bottom of the channels, not shown in the FIGURES, for further stabilizing the joint. Further, the dimensions of the channels and base members may be chosen to obtain a friction fit when joined together As stated hereinabove, channels 32*a* and 32*b* are formed at angles 38*a* and 38*b*, between about 15° and about 30° from axes 40*a* and 40*b*, parallel to the length of chopsticks 14*a* and 14*b*, respectively. Side-indentations are formed at angles 72*a* and 72*b* from axes 40*a* and 40*b*, such that when chopsticks 14*a* and 14*b* are joined into assembly 12 by placing opposing channels 32*a* and 32*b* together, joint 18 is formed having resultant angle 74 (FIG. 8B and FIG. 9 hereof) between chopsticks 14*a* and 14*b*, which is equal to angles 38*a* and 38*b* plus angles 72*a* and 72*b*.

Therefore, angles 72*a* and 72*b* are resultant angles from a choice of the widths (75*a* and 75*b*) of side stops 66*a* and 66*b*, and 68*a* and 68*b*, respectively. As an example: for 6 mm wide chopsticks having a chosen angle 19 of 17°, and a chosen width for side stops 66*a* and 66*b* and 68*a* and 68*b* of 1.2 mm, results in angles 72*a* and 72*b* of approximately 3.5 degrees.

Angles 38*a* and 38*b*, 72*a* and 72*b*, and 74*a* and 74*b*, and chopstick thickness 36*a* and 36*b* affect the widths 76*a* and 76*b* of base members 33*a* and 33*b*. The widths 39*a* and 39*b* of channels 32*a* and 32*b* are approximately equal to the widths 76*a* and 76*b* of base members 33*a* and 33*b*.

As illustrated in FIGS. 8, 10A, 10B, 10C, and 10D, side indentations 58*a*, 60*a*, 58*b*, and 60*b*, and mating surfaces of channels 32*a* and 32*b*, base members 33*a* and 33*b* and side stop faces 66*a*, 66*b*, 68*a*, and 68*b* may be slightly backcut in the direction of assembly, thereby increasing the strength of the interlock holding the assembled pair together. Alternate options include a slightly undersized notch for a tight friction fit, or a series of meshing ribs and grooves, etc. The leading edges, 78*a*, and, 78*b*, 80*a*, and, 80*b*, 82*a*, and, 82*b*, 84*a*, and, 84*b*, 86*a*, and, 86*b*, and 88*a*, and, 88*b*, in the direction of assembly of channels 32*a* and 32*b*, base members 33*a* and 33*b*, and backcut side-cut faces 66*a* and 66*b*, and 68*a* and 68*b*, may be angled or radiused to facilitate the assembly of joint 18.

Figure 11A:
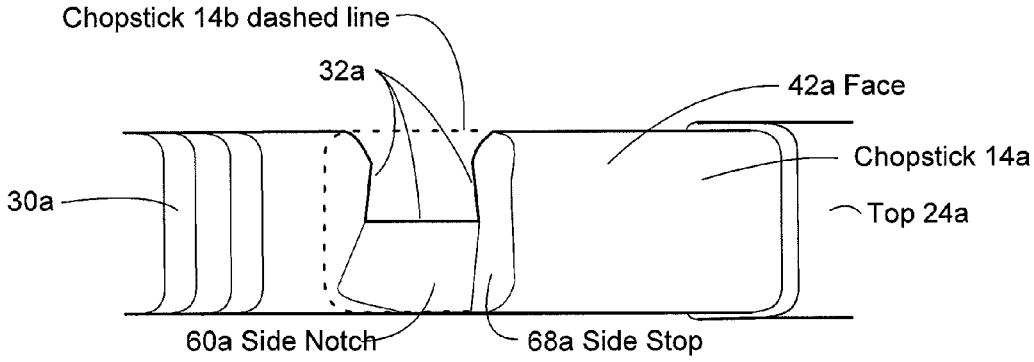
FIG. 11A is a schematic representation of a perspective view looking along the channel at the location illustrated in FIG. 10B hereof and more clearly illustrating the angled, back cut surfaces of the channels and base members in the embodiment.
Figure 11B:
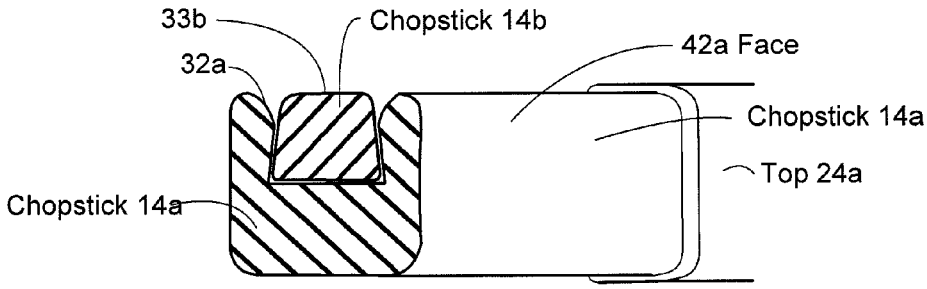
FIG. 11B is a schematic representation of a cross section view looking along the channel at the location illustrated in FIG. 10B hereof.
Figure 11C:
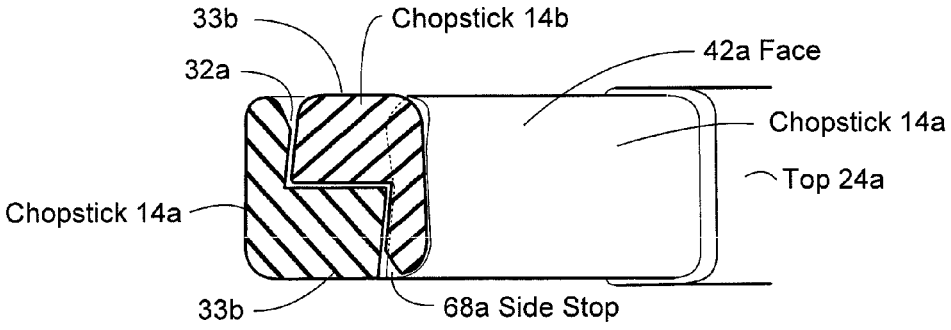
FIG. 11C is a schematic representation of a cross section view looking along the channel at the location illustrated in FIG. 10B hereof.

FIG. 11A is a schematic representation of a perspective view looking along channel 32*a* at the location illustrated in FIG. 10B hereof and more clearly illustrating the angled, back cut surfaces of the channels and base members in the embodiment, FIG. 11B is a schematic representation of a cross section view looking along channel 32*a* at the location illustrated in FIG. 10B hereof, and FIG. 11C is a schematic representation of a cross section view looking along channel 32*a* at the location illustrated in FIG. 10B hereof.

The remaining elements of this embodiment are similar to those described hereinabove, and illustrated in FIGS. 1-6 hereof.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A pair of chopsticks comprising:

a first chopstick having a chosen long dimension an upper side and an opposing lower side, an outer side and an opposing inner side, a food grasping end and a second end, a first channel in the upper side disposed at a chosen angle relative to the long dimension of said first chopstick in the region of the second end thereof, having a selected depth, and a chosen width, and forming a first base member between the depth of the first channel and the lower side;

a second chopstick, identical to said first chopstick, having a chosen long dimension an upper side and an opposing lower side, an outer side and an inner side, a food grasping end and a second end, a second channel in the upper side disposed at a chosen angle relative to the long dimension of said first chopstick in the region of the second end thereof having a selected depth, and a chosen width, and forming a second base member between the depth of the second channel and the lower side;

wherein the first base member of said first chopstick is inserted into the second channel of said second chopstick, with the second base member of said second chopstick being inserted into the first channel of said first chopstick, forming a joint having the chosen angle between said first chopstick and said second chopstick; and a retaining member for holding said first chopstick and said second chopstick together at the joint.

2. The pair of chopsticks of claim 1, wherein the selected depth is half the distance between the upper side and the opposing lower side measured in the vicinity of the first channel.

3. The pair of chopsticks of claim 1, wherein said first chopstick has at least one portion between the grasping end thereof and the first channel having a distance between the inner side and the outer side effective for imparting flexibility to said first chopstick; and wherein said second chopstick has an outer side and an inner side, and at least one portion between the grasping end thereof and the second channel effective for imparting flexibility to said second chopstick.

4. The pair of chopsticks of claim 3, wherein the distance between the inner side and the outer side of said first chopstick is reduced by thinning both the outer side and the inner side thereof, and wherein the distance between the inner side and the outer side of said second chopstick is reduced by thinning both the outer side and the inner side thereof.

5. The pair of chopsticks of claim 4, further comprising packaging enclosing said pair of chopsticks.

6. The pair of chopsticks of claim 5, wherein said retaining member is a separable part of said packaging.

7. The pair of chopsticks of claim 5, wherein said retaining member comprises paper.

8. The pair of chopsticks of claim 1, wherein said retaining member comprises a band or cord capable of being wound around the joint.

9. The pair of chopsticks of claim 1, wherein said retaining member comprises an adhesive.

10. A pair of chopsticks comprising:

a first chopstick having a chosen long dimension an upper side and an opposing lower side, an outer side and an inner side, a food grasping end and a second end, a first channel in the upper side disposed at a chosen oblique angle relative to the long dimension of said first chopstick in the region of the second end thereof, the first channel opening both into the outer side and the inner side and having a first end closest to the second end of said first chopstick, and a second end closest to the grasping end and a midpoint therebetween, having a selected depth, and a chosen width, forming a first base member between the depth of the first channel and the lower side, there being a first indentation in the outer side beginning at the first end of the channel and ending at the midpoint thereof, and a second indentation in the inner side beginning at the second end of the channel and ending at the midpoint thereof, forming a first side stop having a first face, and a second side stop having a second face, respectively, at the midpoint; and a second chopstick, identical to said first chopstick, having a chosen long dimension an upper side and an opposing lower side, an outer side and an inner side, a food grasping end and a second end, a second channel in the upper side disposed at a chosen oblique angle relative to the long dimension of said second chopstick in the region of the second end thereof, the second channel opening both into the outer side and the inner side and having a first end closest to the second end of said second chopstick, and a second end closest to the grasping end and a midpoint therebetween, having a selected depth, and a chosen width, forming a second base member between the depth of the second channel and the lower side, there being a first indentation in the outer side beginning at the first end of the channel and ending at the midpoint thereof, and a second indentation in the inner side beginning at the second end of the channel and ending at the midpoint thereof, forming a first side stop having a first face, and a second side stop having a second face, respectively, at the midpoint;

wherein the first base member of said first chopstick is inserted into the second channel of said second chopstick, with the second base member of said second chopstick being inserted into the first channel of said first chopstick, forming a joint having the chosen oblique angle, wherein the first face of the first side stop of said first chopstick engages the second face of the second side stop of said second chopstick and the second face of the second side stop of said first chopstick engages the first face of the first side stop of said second chopstick, thereby preventing rotation of said first chopstick and said second chopstick in the joint.

11. The pair of chopsticks of claim 10, wherein the selected depth is half the distance between the upper side and the opposing lower side measured in the vicinity of the first channel.

12. The pair of chopsticks of claim 10, wherein the chosen width is less than or equal to the distance between the outer side and the inner side measured in the vicinity of the first channel.

13. The pair of chopsticks of claim 10, wherein the width of the first channel in relation to the second base member and the second channel in relation to the first base member is chosen such that the joint is a friction fit joint.

14. The pair of chopsticks of claim 10, wherein the first face and the second face of said first chopstick and said second chopstick are rounded, and wherein edges of the first channel and the second channel formed at the upper surface are rounded.

15. The pair of chopsticks of claim 10, wherein the first channel and the second channel are backcut to form an interlocking joint therebetween.

16. The pair of chopsticks of claim 10, wherein the first base member and the second base member have interlocking ribbed surfaces.

17. The pair of chopsticks of claim 10, wherein said first chopstick has at least one portion between the food grasping end and the first channel thereof having a cross-section effective for imparting flexibility to said first chopstick; and wherein said second chopstick has at least one portion between the food grasping end and the second channel thereof having a cross section effective for imparting flexibility to said second chopstick.

18. The pair of chopsticks of claim 10, wherein said first chopstick has at least one portion between the grasping end and the thereof and the first channel having a distance between the inner side and the outer side effective for imparting flexibility to said first chopstick; and wherein said second chopstick has an outer side and an inner side, and at least one portion between the grasping end and the thereof and the second channel effective for imparting flexibility to said second chopstick.

19. The pair of chopsticks of claim 18, wherein the distance between the inner side and the outer side of said first chopstick is reduced by thinning both the outer side and the inner side thereof, and wherein the distance between the inner side and the outer side of said second chopstick is reduced by thinning both the outer side and the inner side thereof.

* * * * *